US009630410B2

(12) United States Patent
Leigh et al.

(10) Patent No.: US 9,630,410 B2
(45) Date of Patent: Apr. 25, 2017

(54) THERMAL INKJET PRINTHEAD

(71) Applicant: HEWLETT-PACKARD DEVELOPMENT COMPANY, L.P., Houston, TX (US)

(72) Inventors: Stan E. Leigh, Corvallis, OR (US); Terry Mcmahon, Albany, OR (US); Tom P. Abdilla, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/114,008

(22) PCT Filed: Jan. 29, 2014

(86) PCT No.: PCT/US2014/013524

§ 371 (c)(1),
(2) Date: Jul. 25, 2016

(87) PCT Pub. No.: WO2015/116051

PCT Pub. Date: Aug. 6, 2015

(65) Prior Publication Data

US 2016/0339703 A1 Nov. 24, 2016

(51) Int. Cl.
*B41J 2/14* (2006.01)
*B41J 2/16* (2006.01)

(52) U.S. Cl.
CPC ..... *B41J 2/14427* (2013.01); *B41J 2/14072* (2013.01); *B41J 2/14129* (2013.01); *B41J 2/1603* (2013.01); *B41J 2/1628* (2013.01); *B41J 2/1631* (2013.01); *B41J 2/1642* (2013.01); *B41J 2/1646* (2013.01); *B41J 2/1648* (2013.01)

(58) Field of Classification Search
None
See application file for complete search history.

(56) References Cited

U.S. PATENT DOCUMENTS

| | | | | |
|---|---|---|---|---|
| 5,980,025 | A * | 11/1999 | Burke | B41J 2/14129 29/890.1 |
| 6,325,491 | B1 | 12/2001 | Feinn | |
| 8,444,255 | B2 | 5/2013 | Bakker et al. | |
| 8,552,565 | B2 | 10/2013 | Yen et al. | |
| 2004/0021740 | A1 | 2/2004 | Bell et al. | |
| 2006/0290744 | A1 | 12/2006 | Lee et al. | |
| 2008/0053954 | A1 | 3/2008 | Silverbrook | |
| 2010/0097430 | A1 | 4/2010 | Silverbrook | |
| 2012/0293587 | A1 | 11/2012 | Bakker et al. | |

OTHER PUBLICATIONS

Jae-Duk Lee et al.; A Thermal inkjet Printhead With a Monolithically Fabricated Nozzle Plate and Self-Aligned Ink Feed Hole; Journal of Microelectromechanical Systems, vol. 8, No. 3, Sep. 1999, pp. 229-238.

* cited by examiner

*Primary Examiner* — Lisa M Solomon
(74) *Attorney, Agent, or Firm* — HP Inc.—Patent Development

(57) ABSTRACT

A thermal inkjet printhead is described. The thermal inkjet printhead comprising a passivation layer and a plurality of bond pads formed over the passivation layer. The thermal inkjet printhead further comprises a plurality of insulating strips formed over the passivation layer. The insulating strips are formed such that two adjacent bond pads are separated by an insulating strip, from among the plurality of insulating strips. Further, each of the plurality of the insulating strips is of a dielectric material.

13 Claims, 5 Drawing Sheets

THERMAL INKJET PRINTHEAD

BACKGROUND

Thermal inkjet printers are commonly used in home and office environments for printing images or characters on a print medium to obtain printed documents. The thermal inkjet printers include a thermal inkjet printhead for generating ink drops that are placed on the print medium in accordance to a pixel pattern of the image being printed. The thermal inkjet printhead is typically a silicon chip having thin-film structures, such as an array of thermal resistors and corresponding transistors. The transistors are provided to switch power pulses to the thermal resistors for vaporizing ink for generating the ink drops. The thermal inkjet printhead may include one or more bond pads to provide electrical contacts to various circuitries, such as the transistors implemented in the thermal inkjet printhead.

BRIEF DESCRIPTION OF DRAWINGS

The detailed description is described with reference to the accompanying figures. In the figures, the left-most digit(s) of a reference number identifies the figure in which the reference number first appears. The same numbers are used throughout the figures to reference like features and components.

DETAILED DESCRIPTION

Figure 1:
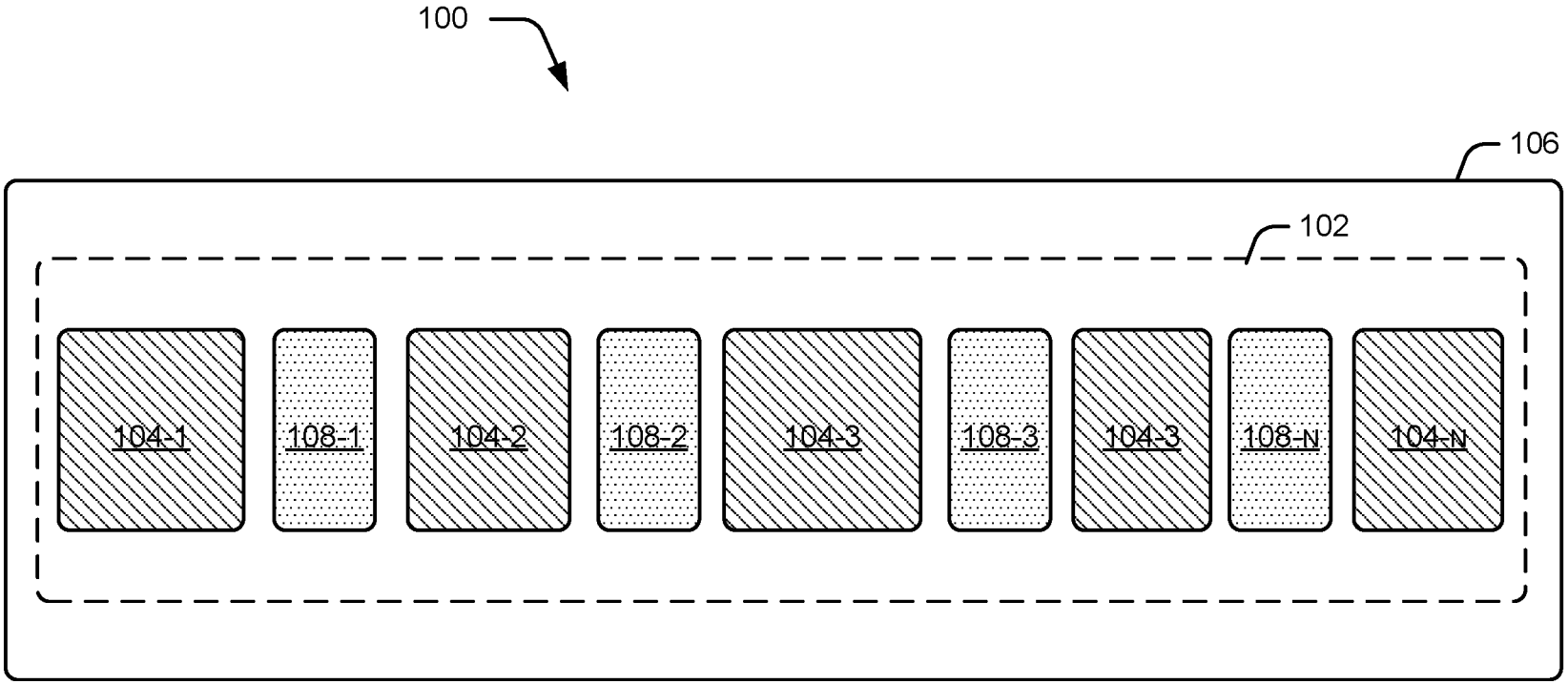
FIG. 1 illustrates a block diagram of a thermal inkjet printhead with a bond pad region, according to an example of the present subject matter.

The present subject matter relates to fabrication of thermal inkjet printheads for thermal inkjet based printing machines. The thermal inkjet based printing machines, also known as the thermal inkjet printers, are used for printing images or characters on a print medium to obtain printed documents. The thermal inkjet printers print images by expelling ink drops over the print medium in accordance to a pattern of the image or the characters that are to be printed.

The thermal inkjet printers include a thermal inkjet printhead for generating ink drops that are placed on the print medium in accordance to a pixel pattern of the image being printed. The thermal inkjet printheads typically include an orifice layer having a plurality of nozzles for expelling a small volume of ink on a print medium upon which printing or marks are to be placed. The orifice layer is attached to an ink barrier layer defining ink channels for connecting each nozzle to a corresponding ink chamber storing the ink. The ink barrier layer is further attached to a layer of thermal resistors such that each ink chamber is associated with a corresponding thermal resistor. The resistors are individually addressed with a current pulse to momentarily vaporize the ink to form a bubble. The bubbles are expelled through the nozzle on the print medium. By energizing heater resistors in different combinations as the printhead moves across the paper, the thermal inkjet printer prints different characters on the paper. In operation, the thermal resistors vaporize the ink drops which are expelled through the nozzles for producing of a portion of a desired character or image on the print medium.

Fabrication of a thermal inkjet printhead typically includes stacking multiple layers of materials, such as metals and insulating materials using a process of complementary metal-oxide-semiconductor (CMOS). The multiple layers are typically deposited over a substrate, such as silicon, using known deposition techniques, such as physical vapor deposition (PVD), chemical vapor deposition (CVD), electrochemical deposition (ECD), molecular beam epitaxy (MBE), and atomic layer deposition (ALD). Further, the multiple layers include, but are not limited to, a resistive layer having one or more thermal resistors, a passivation layer, an adhesion layer, a bond pad layer having one or more bond pads, and one or more polymer layers. The passivation layer is typically formed to provide a protective coating to electrical components, such as the thermal resistors of the thermal inkjet print head.

The bond pads are typically provided in the thermal inkjet printhead for providing electrical contacts to various circuitries, such as the thermal resistors implemented in the thermal inkjet printhead. Usually a metal, such as gold, that is electrically conductive as well as resistive to oxidation and corrosion is used to form the bond pads. Further, owing to the compact design of the thermal inkjet printhead, all the bond pads are stacked next to each other with usually a very small gap between adjacent bond pads. Providing the bond pads so close to each other, however, may cause unwanted electrical connections or shorting between the adjacent bond pads. Such unwanted electrical connections between the adjacent bond pads may lead to reliability concerns in the thermal inkjet printhead as the unwanted electrical connections may cause the printer to operate in an undesired manner or in some cases may even cause printer failure.

Generally to prevent such unwanted electrical connection between the adjacent bond pads, the bond pads are encapsulated using a protective material, such as a polymer and an epoxy for protecting and also electrically isolating the bond pads. Such encapsulation of the bond pads, however, may not completely isolate the bond pads, thus still making the printer susceptible to errors arising due to shorting of bond pads. In such instances, due to small size and geometry of the bond pads and the printhead, a chemical treatment is usually carried out for making the printhead more robust. Such a treatment of the printhead may affect adhesion of the protective material with the passivation layer, over which the bond pads are formed, thus affecting the electrical isolation between the adjacent bond pads.

In another example, the barrier layer may be used to isolate the bond pads by forming the ink chambers of the barrier layer in between the bond pads. Using the barrier layer for isolating the bond pads, however, may affect adhesion of the encapsulation layer on the passivation layer. The encapsulation layer may thus not be able to effectively provide protection and electrical isolation of the bond pads and tape automated bonding (TAB) connections, i.e., electrical connections to various circuitries of the thermal inkjet printhead. Further, providing the barrier layer in between the bond pads is possible with modification of bonding and fabrication process of the thermal inkjet printheads. For instance, owing to presence of the barrier layer in between the bond pads, thickness of the TAB connections may need to be increased in order to prevent a connection between the barrier layer and a bonder thermode. The bonder thermode is typically used to apply force at a predetermined temperature on electrical leads used to create the TAB connections on the bond pads. A contact between the bonder thermode may melt the barrier layer and thus the contact is prevented by increasing the thickness of the TAB connection. Further, such a modification in the bonding process may increase complexity of manufacturing the thermal inkjet printheads.

Thermal inkjet printheads, in accordance with an example of the present subject matter, are described. The thermal inkjet printheads as described include a dielectric layer added in between two adjacent bond pads. The resulting thermal inkjet printheads with the additional dielectric layer achieve electrical isolation between the bond pads, thus reducing chances of printer failure due to unwanted shorting between the bond pads.

In an example implementation, fabricating the thermal inkjet printhead involves depositing one or more functional layers, such as a metal layer, a polysilicon layer, and a resistive layer over a silicon substrate for forming one or more circuitries and thermal resistors used for performing functions of the thermal inkjet printhead. A passivation layer is subsequently formed over the functional layers to protect the functional layers from corrosion and other similar conditions typically associated with a thermal inkjet printhead environment. Subsequently, a bond pad region is formed over the passivation layer by depositing a metal, such as gold over an adhesive material, such as tantalum. In one example, a layer of gold is deposited over a layer of tantalum to obtain the bond pad region.

Once the bond pad region has been formed, a process of photolithography is carried out to create a plurality of bond pads in the bond pad region. Using photolithography, one or more patches of tantalum and gold are removed from the bond pad region to create the plurality of bond pads. For instance, through photolithography patches of tantalum and gold may be etched to form one or more cavities of a predetermined thickness between adjacent bond pads. Therefore, within a bond pad region, a series of bond pads are formed with each bond pad separated from its adjacent bond pad by a dimension equivalent to dimensions of the cavity.

Once the bond pads are created, a dielectric material is deposited on the passivation layer such that the dielectric material covers the entire passivation layer including all exposed surfaces of the bond pads. For instance, the dielectric material is deposited over each bond pad and in the cavity formed between two adjacent bond pads. In one example implementation, an SU8 primer may be used as the dielectric material. Subsequently, the dielectric material may be removed from certain areas, such as from a top surface of the bond pads to clean the bond pads for making electrical connections. In one example, the dielectric material may be removed using the process of photolithography. An etching mask defining the areas from where the dielectric material is to be removed may be used for performing the process of photolithography. The etching mask according to the present subject matter may thus define the areas such that the dielectric material deposited in between two adjacent bond pads is not removed during the process of photolithography.

The above described process of photolithography using the etching mask thus removes the dielectric material such that each bond pad is separated from an adjoining bond pad by an insulating strip composed of the dielectric material. Separating the adjoining bond pads by the insulating strip prevents unwanted electrical connections between the bond pads, thus electrically insulating the bond pads.

Further, a bond wire is connected to each of the plurality of bond pads using the process of tape automated bonding to provide the TAB connections to various circuitries of the thermal inkjet printhead. Subsequently the bond pad region is encapsulated using a protective material, such as a polymer and an epoxy to obtain an encapsulating region for protecting the bond pads and the TAB connections.

The present subject matter provides for thermal inkjet printheads which include electrically insulated adjacent bond pads. As should be noted, due to the electrical insulation of the bond pads from each other, the reliability of the thermal inkjet printhead is further increased. This may directly contribute to the quality and operational life of the printers implementing such thermal inkjet printheads. Consequently, maintenance costs of such printers are also reduced. The dielectric material further acts as an adhesion promoter, thereby facilitating adhesion of the protective material over the passivation layer. This further enhances insulation of the bond pads due to the insulating capabilities of the protective material. Enhancing the adhesion of the protective material used for encapsulation further achieves effective protection of the TAB connections over the bond pads.

The manner in which the present subject matter is implemented is explained in details with respect to FIGS. 1 to 4. While aspects of the present subject matter can be implemented in any number of different systems, environments, and/or configurations, the examples are described in the context of the following system(s).

FIG. 1 illustrates a block diagram of a thermal inkjet printhead 100 with a bond pad region, according to an example of the present subject matter. The thermal inkjet printhead 100 may be used in a thermal inkjet printer (not shown in the figure) for generating and ejecting ink drops on a print medium for printing an image on the print medium.

A bond pad region 102 may be defined as a region having one or more bond pads 104-1, 104-2, 104-3, 104-4, . . . , **104-*n* for providing electrical connection to one or more components of the thermal inkjet printhead 100. The bond pads 104-1, 104-2, 104-3, 104-4, . . . , 104-*n* are hereinafter collectively referred to as bond pads 104 and individually referred to as bond pad 104. As illustrated in FIG. 1, the bond pads 104 are formed over a passivation layer 106 of the thermal inkjet printhead 100. The bond pad region 102 may be formed by depositing an adhesive material, such as tantalum and an electrically conducting layer of a metal, like gold over the passivation layer 106**.

The passivation layer 106 may be understood as a protective layer formed over one or more functional layers (not shown in the figure) of the thermal inkjet printhead 100 to protect the functional layers from corrosion, oxidation, and other similar conditions associated with a thermal inkjet printhead environment. The functional layers, such as a metal layer, a polysilicon layer, and a resistive layer may be defined as layers forming one or more circuitries and components. The circuitries and components, such as thermal resistors may be used for performing various functions of the thermal inkjet printhead 100.

The thermal inkjet printhead 100 further includes a plurality of insulating strips 108-1, 108-2, 108-3, . . . , **108-*n*. In one example, the insulating strips 108-1, 108-2, 108-3, . . . , 108-*n*, collectively referred to as insulating strips 108 and individually referred to as insulating strip 108, are formed over the passivation layer 106 such that each bond pad 104 is separated from an adjacent bond pad 104 by the insulating strip 108. For instance, one of the insulating strips 108, say, the insulating strip 108-2 is formed between the bond pads 104-2 and 104-3 thus separating the bond pad 104-2 and the bond pad 104-3. In one example implementation, the insulating strip 108 is made from a dielectric material, such as a SU8 primer that acts as an insulator between the bond pads 104. Providing the insulating strip 108 in between two adjacent bond pads 104 avoids accidental electrical connections between the bond pads 104**. Further, in one example, the insulating strip may have a thickness in a range of about 2 micrometer (μm) and 6 μm.

Further, the dielectric material used as the insulating strips 108 facilitates adhesion of a protective material over the passivation layer 106. The protective material is used for encapsulating the bond pads 104 and TAB connections (not shown in this figure) formed over the bond pads 104. Enhancing the adhesion of the protective material facilitates effective protection of the TAB connections and the bond pads 104. Effective adhesion of the protective material further enhances insulation of the bond pads 104 due to the insulating capabilities of the protective material.

Figure 2A:
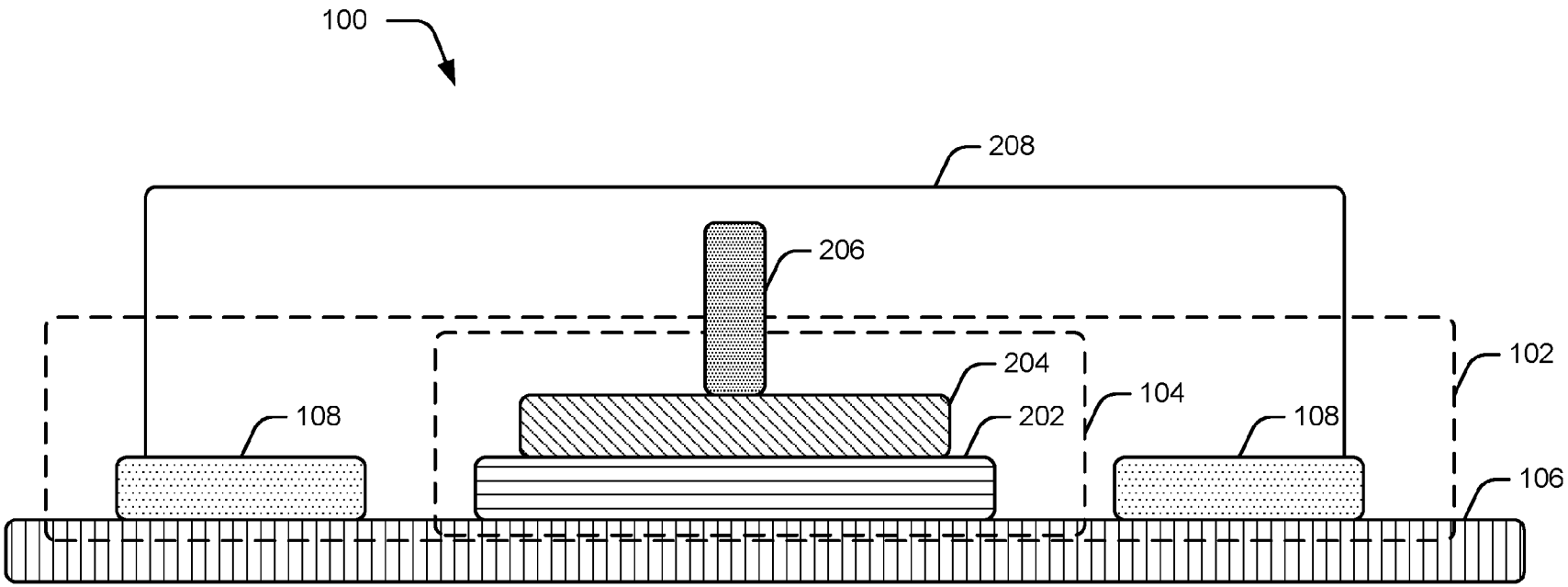
FIG. 2*a* illustrates a front view of the thermal inkjet printhead with the bond pad region, according to an example of the present subject matter.

FIG. 2*a* illustrates a front view of the thermal inkjet printhead 100 with the bond pad region 102, according to an example of the present subject matter. As previously described, the thermal inkjet printhead 100 comprises of multiple layers of materials deposited over each other using one or more deposition techniques. Examples of the deposition technique include, but are not limited to, physical vapor deposition (PVD), chemical vapor deposition (CVD), electrochemical deposition (ECD), plasma-enhanced chemical vapor deposition (PECVD), molecular beam epitaxy (MBE), and atomic layer deposition (ALD). Although, the thermal inkjet printhead 100 includes multiple layers, just few layers useful for description of the present subject matter have been shown in the FIG. 2*a*.

In order to fabricate the thermal inkjet printhead 100, initially the functional layers are formed over a silicon substrate (not shown in the figure) using the deposition techniques previously described. For instance, a layer of field oxide (not shown in the figure) and a polysilicon layer (not shown in the figure) may be initially grown over the silicon substrate. Subsequently, one or more metal layer (not shown in the figure) and a resistive layer (not shown in the figure) may be deposited over the silicon substrate to form the circuitries and components, such as thermal resistors of the thermal inkjet printhead 100.

Subsequently, the passivation layer 106 may be formed over the functional layers by depositing a composite of silicon carbide (SiC) or silicide nitride (SiN), or a combination of such materials. In one example, the passivation layer 106 may be deposited using the technique of PECVD. Further, the passivation layer 106 may have a thickness in a range of about 0.1 μm and 1 μm. For the sake of clarity, the passivation layer 106 is represented by horizontal lines.

Further, the bond pad region 102 is formed over the passivation layer 106 by depositing the adhesive material and the metal as described above. Initially, the adhesive material is deposited over the passivation layer 106 to obtain an adhesive layer 202. The adhesive layer 202 may be deposited using a technique of sputter deposition in which the adhesive material, such as tantalum is sputtered over the passivation layer 106. The adhesive layer 202 may be formed to facilitate adhesion of the metal to the passivation layer 106 for forming the bond pads 104.

The metal, such as gold may then be deposited over the adhesive layer 202 to obtain a bond pad layer 204 and in turn the bond pad region 102. The metal may be deposited using a technique of sputter deposition in which the metal is sputtered over the adhesive layer 202 to obtain the bond pad layer 204. Being electrically conductive and capable of resisting oxidation and corrosion, gold facilitates in providing an efficient bond pad in the thermal inkjet printhead 100. Once the bond pad region 102 is formed, the bond pads 104 are obtained using a process of lithography. The bond pads 104 may be obtained using the process of photolithography. In one example implementation, a bond pad mask (not shown in the figure) is used to trace design of the bond pads 104 that are to be formed in the region. The bond pad masks may be designed in accordance to the size and shape of the bond pads 104 that are to be formed. In one example, the bond pad masks may be of different sizes owing to difference in sizes of the bond pads 104. For instance, as the bond pads 104 are formed to provide electrical connections to various components of the thermal inkjet printhead 100, sizes of the bond pads 104 may vary in accordance to the type of the connection and size of a bond wire 206 connecting the bond pad 104 to the components.

Further, etching of the bond pad region 102 may be performed to remove one or more patches of the adhesive material and the metal from the adhesive layer 202 and the bond pad layer 204 to create the bond pads 104 in the bond pad region 102. Examples of etching process include, but are not limited to, wet etching, dry etching, chemical-mechanical planarization (CMP), reactive-ion etching (RIE), and deep reactive-ion etching (DRIE). Further, the etching may be isotropic or anisotropic.

As previously described, the bond pads 104 are created such that each bond pad 104 is separated from an adjacent bond pad 104 by a predetermined distance, thus forming a cavity of a predetermined thickness between two adjacent bond pads 104. The predetermined distance and the predetermined thickness may be selected based on various factors, such as number of bond pads 104 to be formed, minimum distance to be kept between the bond pads 104 to avoid short circuit between the bond wires 206, and thickness of the insulating strips 108.

Subsequently, the dielectric material is deposited on the passivation layer 106 to obtain the insulating strips 108. In one example, the dielectric material, such as SU8 primer is deposited such that the entire passivation layer 106, including all exposed surfaces, such as top and sides of the bond pads 104, is covered by the dielectric material. The dielectric material is thus deposited in the cavity formed between two adjacent bond pads 104. Further, the dielectric material is removed from certain areas. For instance, the dielectric material may be removed from the cavity between the bond pads 104 if the predetermined thickness of the cavity is more than the thickness of the insulating strips 108. Similarly, the dielectric material may also be removed from a top surface of the bond pads 104 to clean the bond pads for making electrical connections. The dielectric material may be removed using the process of photolithography as used for forming the bond pads.

In an example, an etching mask (not shown in the figure) may be used for removing the dielectric material. The etching mask defines the areas from where the dielectric material is to be removed using the process of photolithography. The etching mask may be used to trace areas that have to be removed or retained during photolithography. Upon tracing the areas to be removed or retained, using the etching mask, etching may be performed to remove the dielectric material from the areas where the dielectric material is not to be retained. Etching of the excess dielectric material from the passivation layer 106 results in the formation of the insulating strips 108 such that two adjoining bond pads 104 are separated by the insulating strip 108.

Once the bond pads 104 are created, the bond wire 206 is connected on the bond pads 104 to provide electrical connections to various circuitries of the thermal inkjet printhead 100. As illustrated in the FIG. 2*a*, the bond wire 206 is connected to the bond pad layer 204 to form the electrical connections. In one example, the bond wire 206 is connected to the bond pad 104 using a process of tape automated bonding (TAB) to form the electrical connections, i.e., TAB connections.

The bond pad region 102 is further encapsulated using a protective material to obtain an encapsulating region 208 for protecting the bond pads 104, the insulating strips 108, and the TAB connections. Examples of the protective material include, but are not limited to, a polymer and an epoxy.

Figure 2B:
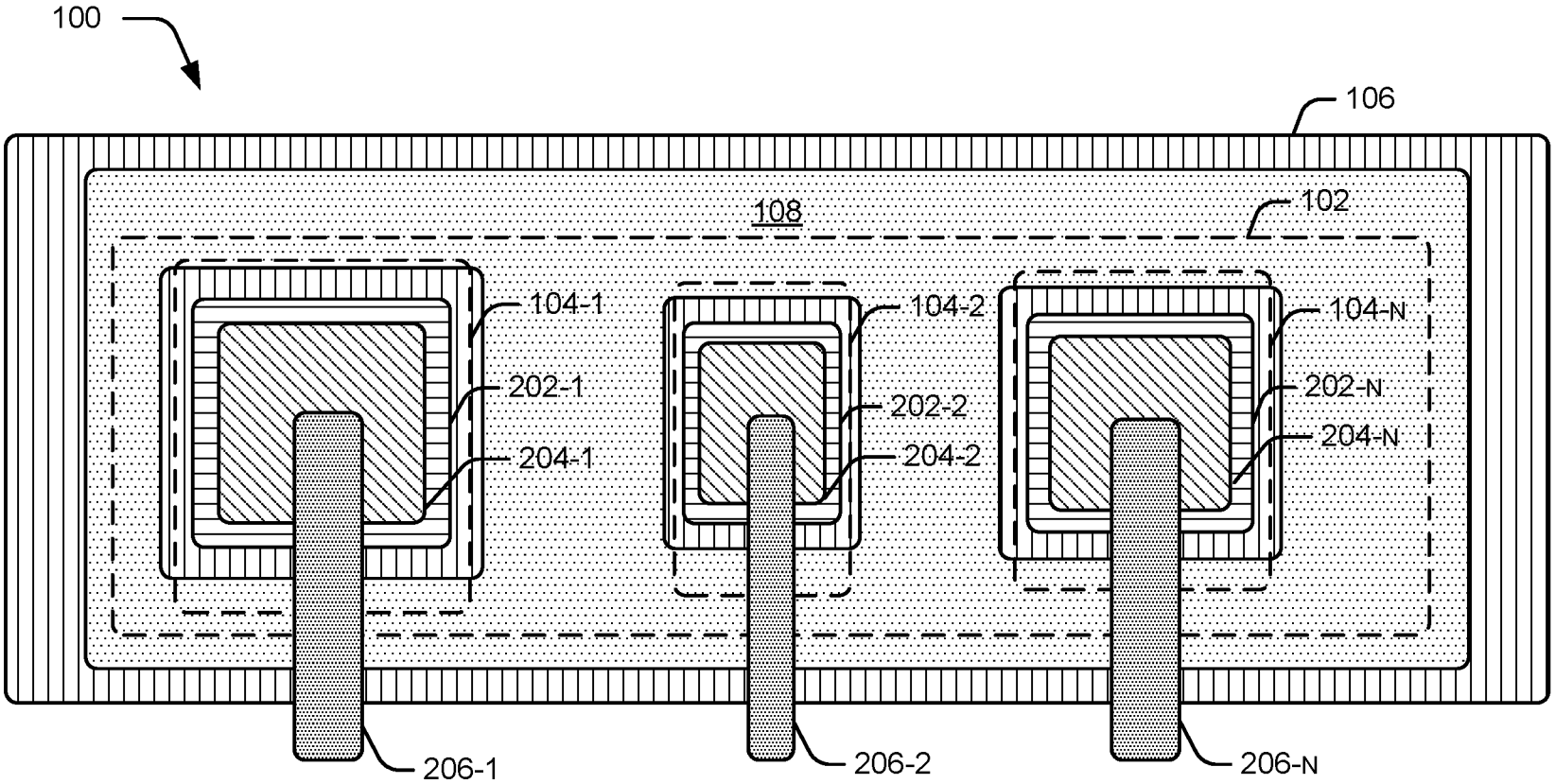
FIG. 2*b* illustrates a top view of the thermal inkjet printhead with the bond pad region, according to an example of the present subject matter.

FIG. 2*b* illustrates a top view of the bond pad region 102 of the thermal inkjet printhead 100, according to an example of the present subject matter. As illustrated, one or more bond wires 206-1, 206-2, . . . , 206-*n* are connected to bond pads 104-1, 104-2, and 104-*n*, respectively. The bond wires 206-1, 206-2, . . . , 206-*n* are hereinafter collectively referred to as the bond wires 206 and individually referred to as the bond wire 206. Further, due to etching and deposition of the dielectric material, the bond pad layer 204 and the adhesive layer 202 have been broken into smaller sections. For instance, the adhesive layer 202 has been divided into smaller sections of adhesive layers 202-1, 202-2, . . . , 202-*n*, while the bond pad layer 204 has been divided into smaller sections of bond pad layer 204-1, 204-2, . . . , 204-*n*.

Figure 3:
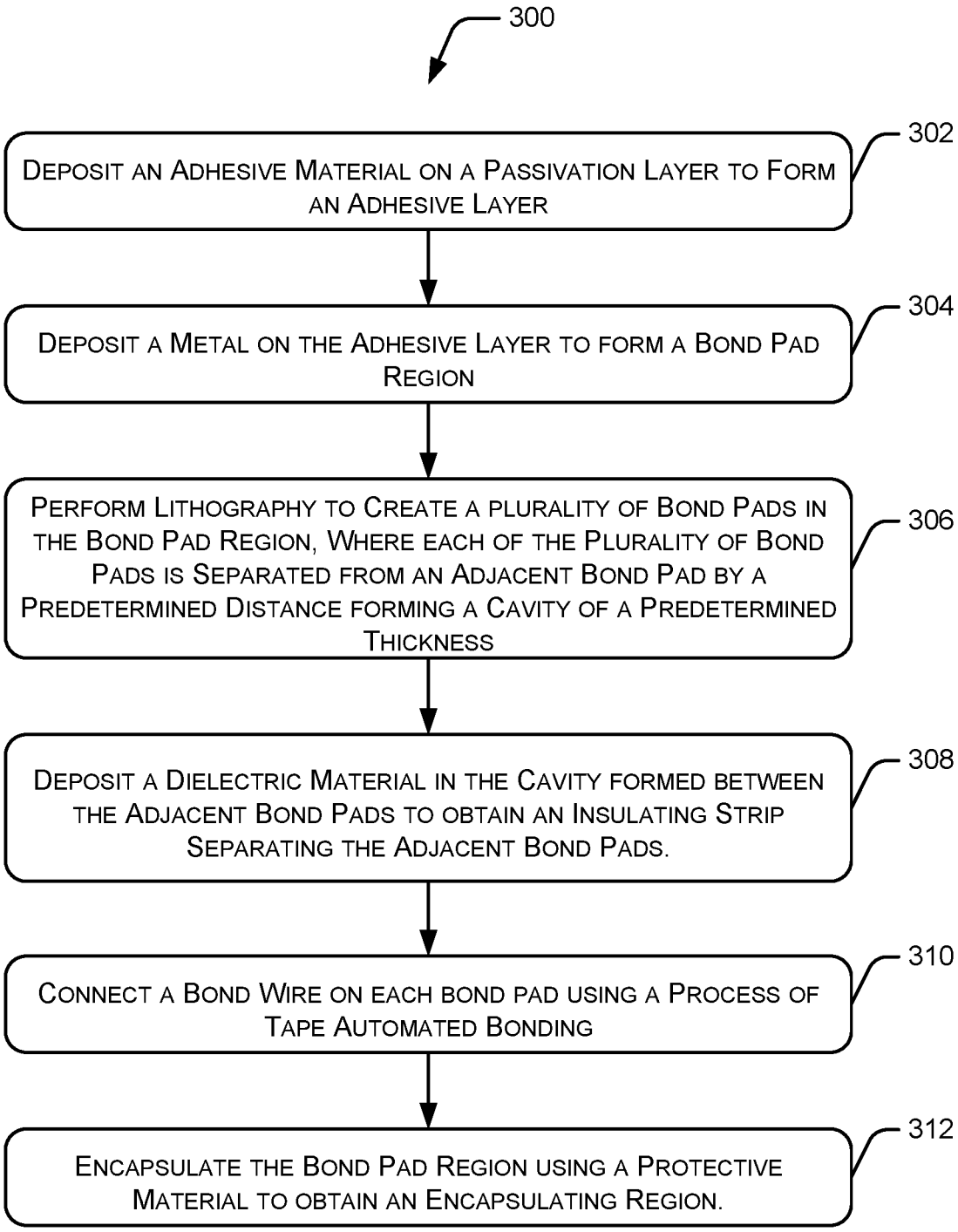
FIG. 3 illustrates a method of fabricating a thermal inkjet printhead, in accordance with an example of the present subject matter.
Figure 4:
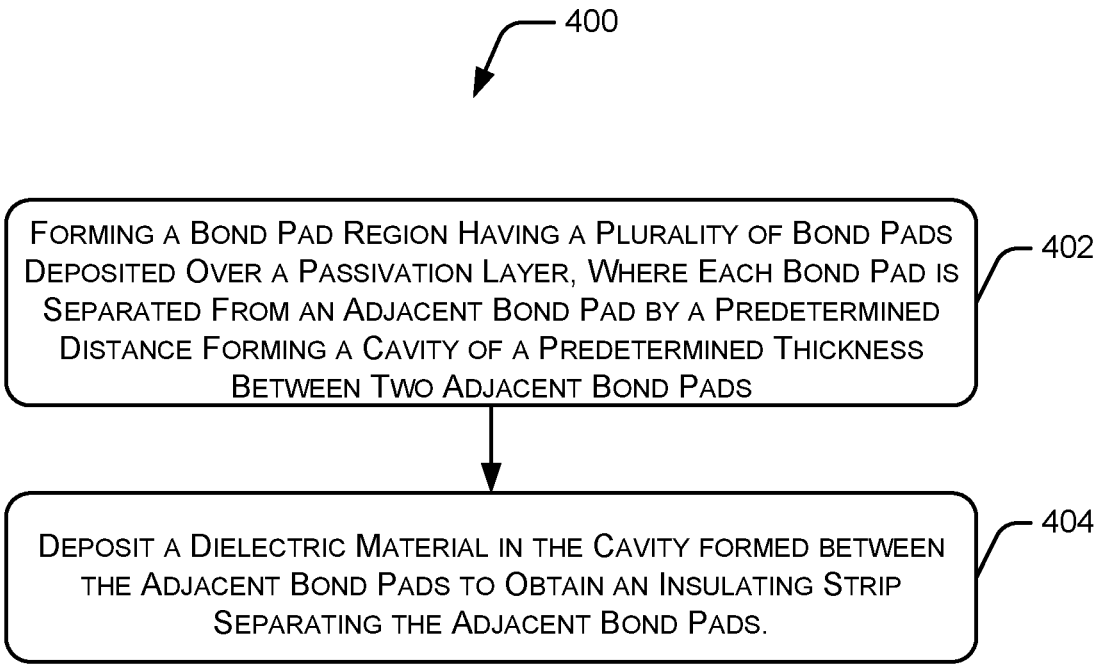
FIG. 4 illustrates a method of fabricating a thermal inkjet printhead, in accordance with an example of the present subject matter.

FIGS. 3 and 4 illustrate a method 300 and a method 400 for fabricating a thermal inkjet printhead, in accordance with an example of the present subject matter. The order in which the methods 300 and 400 are described is not intended to be construed as a limitation, and any number of the described method blocks can be combined in any order to implement the methods 300 and 400, or an alternative method. Additionally, individual blocks may be deleted from the methods 300 and 400 without departing from the spirit and scope of the subject matter described herein. Furthermore, the methods 300 and 400 can be implemented for any suitable hardware.

Further, although the methods 300 and 400 may be implemented for fabricating a variety of inkjet printheads, in examples described in FIG. 3 and FIG. 4, the methods 300 and 400 are explained in context of the aforementioned thermal inkjet printhead 100.

FIG. 3 illustrates the method 300 for fabricating a thermal inkjet printhead, in accordance with an example of the present subject matter.

At block 302, an adhesive material is deposited on a passivation layer. In one example implementation, a process of sputter deposition is used to deposit the adhesive material on the passivation layer of a thermal inkjet printhead, say, the thermal inkjet printhead 100. For example, an adhesive material, such as tantalum may be deposited on the passivation layer, say, the passivation layer 106 to form an adhesive layer, say, the adhesive layer 202.

At block 304, a metal is deposited on the adhesive layer to form a bond pad region. In one example implementation, the metal may be deposited on the adhesive layer using a process of sputter deposition to form a bond pad region. For example, a metal, such as gold is deposited on the adhesive layer 202 to form a bond pad layer 204, thus forming a bond pad region, say, the bond pad region 102.

At block 306, perform lithography to create a plurality of bond pads in the bond pad region. In one example, the process of lithography includes tracing design of the bond pads that are to be formed in the bond pad region using a bond pad mask and then etching the bond pad region based on the trace design to create the bond pads in the bond pad region. For example, a process of photolithography may be carried out on the bond pad layer 204 and the adhesive layer 202 to obtain the bond pads 104. Further, the bond pads are created such that each bond pad is separated from an adjacent bond pad by a predetermined distance, thus forming a cavity of a predetermined thickness.

At block 308, a dielectric material is deposited in the cavity formed between the adjacent bond pads. In one example, a dielectric material, such as SU8 primer is deposited on the passivation layer such that the dielectric material covers the entire passivation layer including the bond pads and the cavities formed between the bond pads. Photolithography is subsequently performed to remove the dielectric material from certain areas, such as top of the bond pads using an etching mask defining the areas from where the dielectric material is to be removed. The etching mask according to the present subject matter may thus define the areas such that an insulating strip of the dielectric material is formed between the adjoining bond pads.

At block 310, a bond wire is connected to the bond pad. In one example, bond wires are bonded to the bond pads using a process of tape automated bonding (TAB) to obtain electrical connections for the thermal inkjet printhead. For example, bond wire 206 may be bonded to the bond pad 104 using the TAB process.

At block 312, the bond pad region is encapsulated using a protective material to obtain an encapsulation region. In one example, the bond pad region is encapsulated using the protective material, such as a polymer and an epoxy.

FIG. 4 illustrates the method 400 for fabricating a thermal inkjet (thermal inkjet) printhead, in accordance with an example of the present subject matter.

At block 402, a bond pad region is formed over a passivation layer. In one example, the bond pad region includes a plurality of band pads such that each bond pad is separated from an adjacent bond pad by a predetermined distance. For example, the bond pad region 102 may be formed over the passivation layer 106 such that each bond pad 104 is at predetermined distance from the adjoining bond pad 104, thus forming a cavity of a predetermined thickness between the adjacent bond pads.

At block 404, a dielectric material is deposited in the cavity formed between the adjacent bond pads. In one example, a dielectric material, such as SU8 primer is deposited in the cavity such that an insulating strip of the dielectric material is formed between the adjoining bond pads. In an example, initially the dielectric material is deposited on the passivation layer. Photolithography is subsequently performed to remove the dielectric material from certain areas, such as top of the bond pads using an etching mask defining the areas from where the dielectric material is to be removed. The etching mask according to the present subject matter may define the areas such that insulating strip is formed in between the bond pads.

Although examples for the present subject matter have been described in language specific to structural features and/or methods, the present subject matter is not necessarily limited to the specific features or methods described. Rather, the specific features and methods are disclosed and explained in the context of a few examples of the present subject matter.

We claim:

1. A thermal inkjet printhead comprising:

a passivation layer;

a plurality of bond pads formed over the passivation layer; and a plurality of insulating strips formed over the passivation layer, wherein two adjacent bond pads are separated by an insulating strip, from among the plurality of insulating strips, and wherein each of the plurality of the insulating strips are of a dielectric material.

2. The thermal inkjet printhead as claimed in claim 1, wherein the insulating strip has a thickness in a range of about 2 micrometer (μm) to 6 μm.

3. The thermal inkjet printhead as claimed in claim 1, wherein the dielectric material is a SU8 primer.

4. The thermal inkjet printhead as claimed in claim 1, wherein each of the plurality of bond pads comprises:

an adhesive layer of tantalum; and a bond pad layer of gold, wherein the bond pad layer of gold is deposited over the adhesive layer of tantalum.

5. The thermal inkjet printhead as claimed in claim 1, wherein the plurality of bond pads is formed over the passivation layer.

6. The thermal inkjet printhead as claimed in claim 1 further comprising a plurality of bond wires, wherein each of the plurality of bond wires is connected to a corresponding bond pad, from among the plurality of bond pads using tape automated bonding.

7. A method for fabricating a thermal inkjet printhead, the method comprising:

forming a bond pad region having a plurality of bond pads deposited over a passivation layer, wherein each of the plurality of bond pads is separated from an adjacent bond pad by a predetermined distance forming a cavity of a predetermined thickness between two adjacent bond pads; and depositing a dielectric material in the cavity formed between the adjacent bond pads to obtain an insulating strip separating the adjacent bond pads.

8. The method as claimed in claim 7, wherein the forming the bond pad region further comprises:

depositing an adhesive material on the passivation layer using a technique of sputter deposition to form an adhesive layer;

depositing a layer of metal over the adhesive layer using the technique of sputter deposition to create the bond pad region; and creating the plurality of bond pads in the bond pad region using a process of lithography, wherein one or more patches of the adhesive material and the metal are removed from the bond pad region to form the cavity of the predetermined thickness between the adjacent bond pads.

9. The method as claimed in claim 8, wherein the plurality of bond pads are created using the process of photolithography.

10. The method as claimed in claim 7, wherein the depositing the dielectric material further comprising:

depositing the dielectric material on the passivation layer, wherein the dielectric material is deposited over the plurality of bond pads and in the cavity formed between the adjacent bond pads; and performing a process of photolithography to remove the dielectric material deposited over the plurality of bond pads using an etching mask.

11. The method as claimed in claim 7 further comprising:

bonding a bond wire on each of the plurality of bond pads using a process of tape automated bonding; and encapsulating the bond pad region using a protective material to obtain an encapsulating region.

12. The method as claimed in claim 7, wherein the insulating strip has a thickness in a range of about 2 micrometer (μm) to 6 μm.

13. The method as claimed in claim 7, wherein the dielectric material is a SU8 primer.

* * * * *